US010626724B1

(12) United States Patent
Abreu et al.

(10) Patent No.: US 10,626,724 B1
(45) Date of Patent: Apr. 21, 2020

(54) INSTALLATION TOOL FOR A ROCK BOLT

(71) Applicant: INNOVATIVE MINING PRODUCTS (PTY) LTD, Johannesburg (ZA)

(72) Inventors: Rual Abreu, Johannesburg (ZA); Luendren Govender, Johannesburg (ZA)

(73) Assignee: EPIROC ROCK DRILLS AB, Orebro (SE)

( * ) Notice: Subject to any disclaimer, the term of this patent is extended or adjusted under 35 U.S.C. 154(b) by 0 days.

(21) Appl. No.: 16/534,381

(22) Filed: Aug. 7, 2019

(51) Int. Cl.
*E21D 20/00* (2006.01)

(52) U.S. Cl.
CPC ..... *E21D 20/00* (2013.01)

(58) Field of Classification Search
CPC ..... E21D 20/00
USPC ..... 405/259.1; 81/121.1, 124.2
See application file for complete search history.

(56) References Cited

U.S. PATENT DOCUMENTS 342,824 A * 6/1886 Clark ..... B25B 13/08 81/125.1
798,325 A * 8/1905 Daddysman, Jr. ..... B25B 13/08 81/125.1
845,717 A * 2/1907 Miller ..... B25B 13/065 81/121.1
863,551 A * 8/1907 Mulrony ..... B25B 13/065 81/121.1
1,321,776 A * 11/1919 Stepanian ..... B25B 13/48 81/124.2
2,116,770 A * 5/1938 Scillia ..... E03B 9/04 137/326
2,213,630 A * 9/1940 Gade ..... B21K 1/463 411/396
3,768,345 A * 10/1973 Barnes ..... B25B 13/02 81/176.15
5,048,378 A * 9/1991 Nikolas ..... B25B 13/06 81/124.2
6,244,787 B1 * 6/2001 Seegmiller ..... B25B 13/06 405/259.1
6,698,317 B1 * 3/2004 Machovsky ..... B25B 13/02 81/124.2

* cited by examiner

*Primary Examiner* — Tara Mayo-Pinnock
(74) *Attorney, Agent, or Firm* — Young & Thompson

(57) ABSTRACT

Disclosed is a rock bolt installation tool for installation of a rock bolt assembly into a predrilled rock hole. The tool includes a drive shaft having a proximal end, which is adapted to engage with a drill rig, and a distal end. A socket in the distal end includes a first containment portion, of a first diameter, which has a base and a second containment portion, of a second diameter, between the first containment portion and the second end. The first containment portion is adapted to receive a nut of the rock bolt assembly. The second containment portion is adapted to receive a load-indicator of the rock bolt assembly. The base and the second end are adapted to provide surfaces against which the nut and a spherical seat of the rock bolt assembly respectively engage to be driven into the rock hole.

17 Claims, 5 Drawing Sheets

INSTALLATION TOOL FOR A ROCK BOLT

BACKGROUND OF THE INVENTION

This invention relates to a rock bolt installation tool for use in the installation of a rock bolt assembly into a predrilled rock hole.

In a typical rock bolt installation, a leading end of a rock bolt is at least partially inserted into a rock hole and a trailing end of the rock bolt is engaged with a complementary formation on installation equipment, such as a drill rig, jackleg drill or bolter (hereinafter referred to as a drill rig), in order to install the rock bolt in the rock hole.

To increase stability and to ensure that the rock bolt is maintained in axial alignment with the rock hole, the drill rig is often provided with a prop which engages with a face of the rock mass, into which the rock bolt is to be inserted, and onto which several guide rings are engaged, longitudinally spaced. It is through these rings that the rock bolt passes to guide the bolt into the hole without bending. Often, these guide rigs are removed from the drill rig to remove interference with the passage of a rock bolt with an associated faceplate or the like. Without these guiding formations, the percussive force of the drill rig concentrated on the trailing end of the rock bolt causes the rock bolt to bend during insertion which compromises the rock bolt installation.

A further problem arises when a load indicator is included in the rock bolt assembly, interposed between the nut and spherical seat.

During mechanised installation, the load indicator is pushed against a spherical seat which, in turn, is forced against a faceplate, when the faceplate bottoms out against the rock wall. An operator of the drill rig cannot avoid such a situation as he cannot judge or accurately control the installation depth of the bolt. He will continue to drive the bolt into the hole until the bolt stops moving forwardly.

As a result, the load indicator will be progressively squashed between a trailing formation, such as a nut, and the spherical seat which action can cause premature collapse of the spherical seat as a result of the percussive force of installation rather than a rotationally applied pre-tensioning force. The collapse of the load indicator in this manner results in a false indication that the rock bolt has been sufficiently pretensioned.

The invention at least partially sources the aforementioned problem.

SUMMARY OF INVENTION

The invention provides a rock bolt installation tool for use in the installation of a rock bolt assembly into a predrilled rock hole, which tool includes a drive shaft having a proximal end, which is adapted to engage with a drill rig, and a distal end, a socket in the distal end that includes a first containment portion, of a first diameter, which has a base and a second containment portion, of a second diameter, between the first containment portion and the second end, wherein the first containment portion is adapted to receive a nut of the rock bolt assembly, wherein the second containment portion is adapted to receive a load-indicator of the rock bolt assembly, and wherein the base and the second end are adapted to provide surfaces against which the nut and a spherical seat of the rock bolt assembly respectively engage to be driven into the rock hole.

The second diameter of the second containment portion may be larger than the first diameter of the first containment portion.

The distal end of the drive shaft may be adapted with a threaded male or female section.

The first portion may be adapted in a hex shape to receive a hex shaped nut.

The drive shaft may have a conduit which runs the length of the shaft opening at the proximal end and opening through the base, into the socket.

BRIEF DESCRIPTION OF THE DRAWINGS

The invention is further described by way of examples with reference to the accompanying drawings in which.

and

Figure 6:
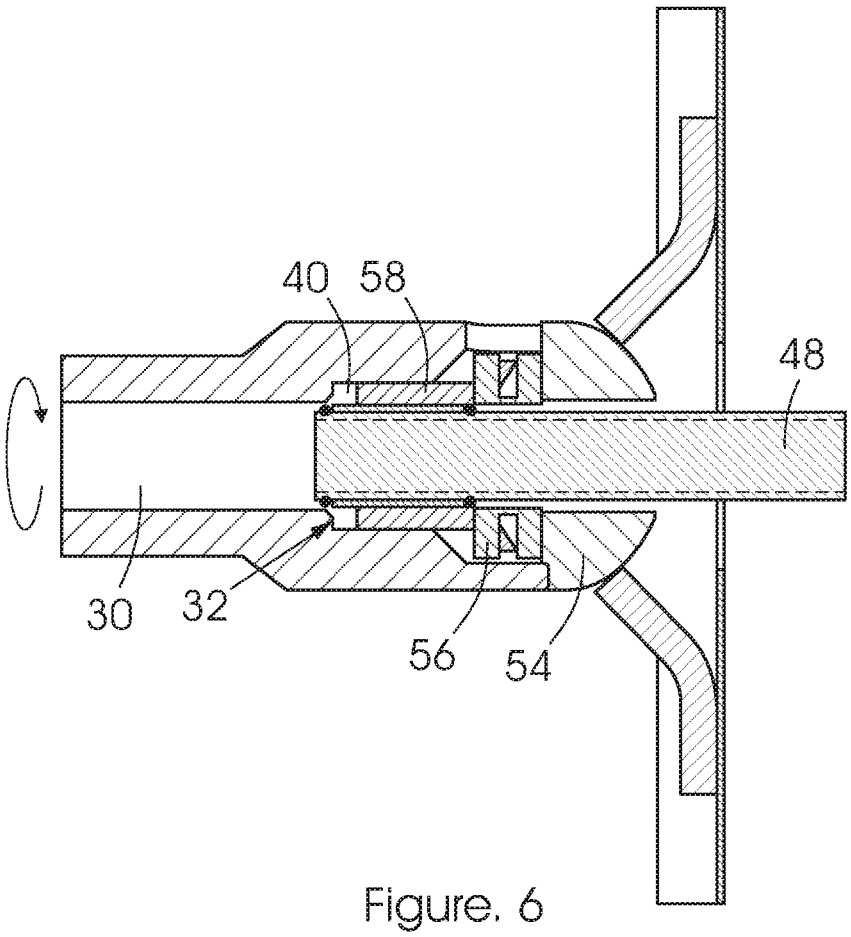

FIG. 6 illustrates a longitudinal section through an end of the rock bolt installation tool, with a trailing end of a rock bolt engaged with the tool, in a second configuration.

DESCRIPTION OF PREFERRED EMBODIMENTS

Figure 1:
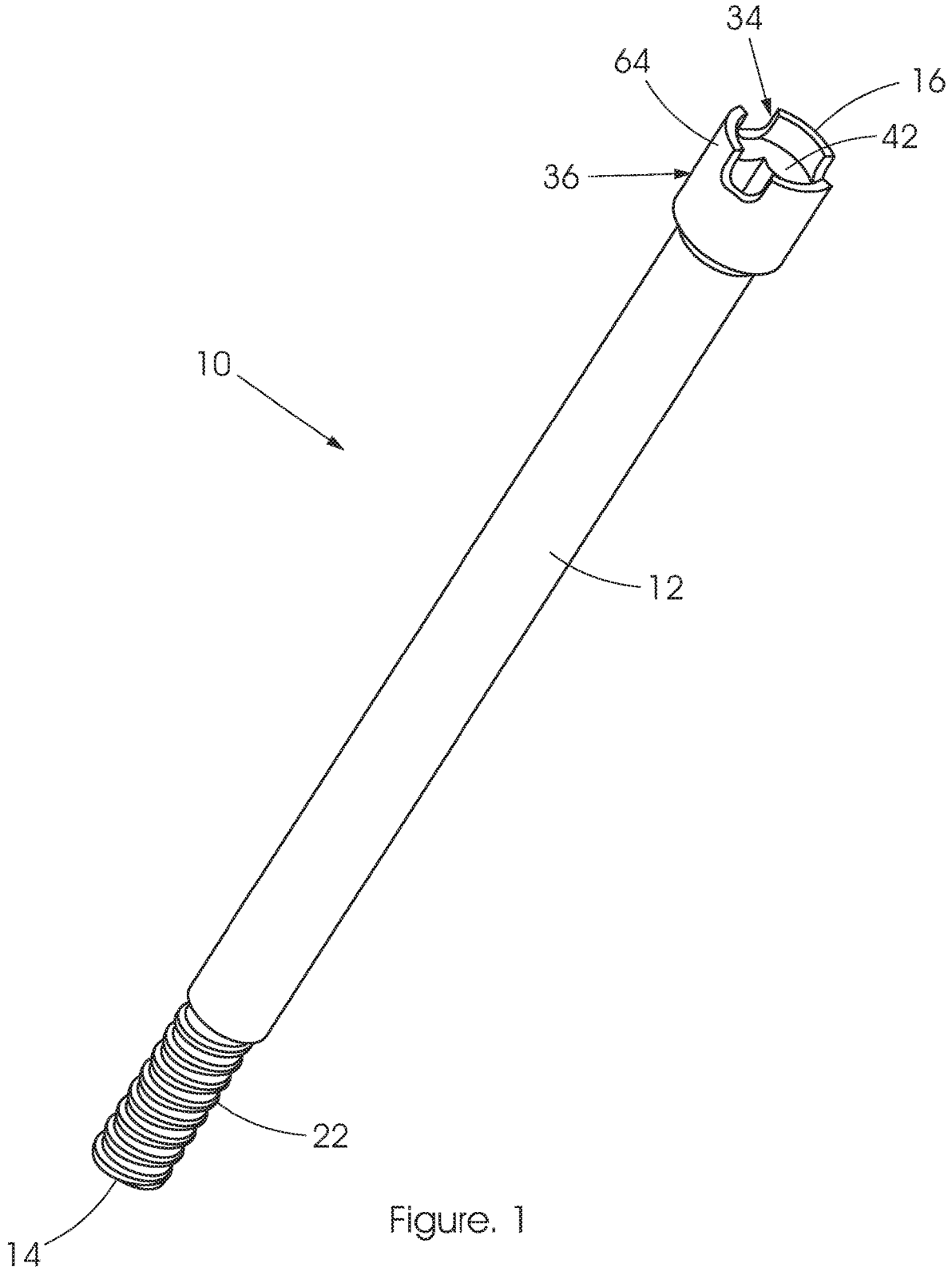
FIG. 1 is a view in perspective of a rock bolt installation tool in accordance with the invention.
Figure 2:
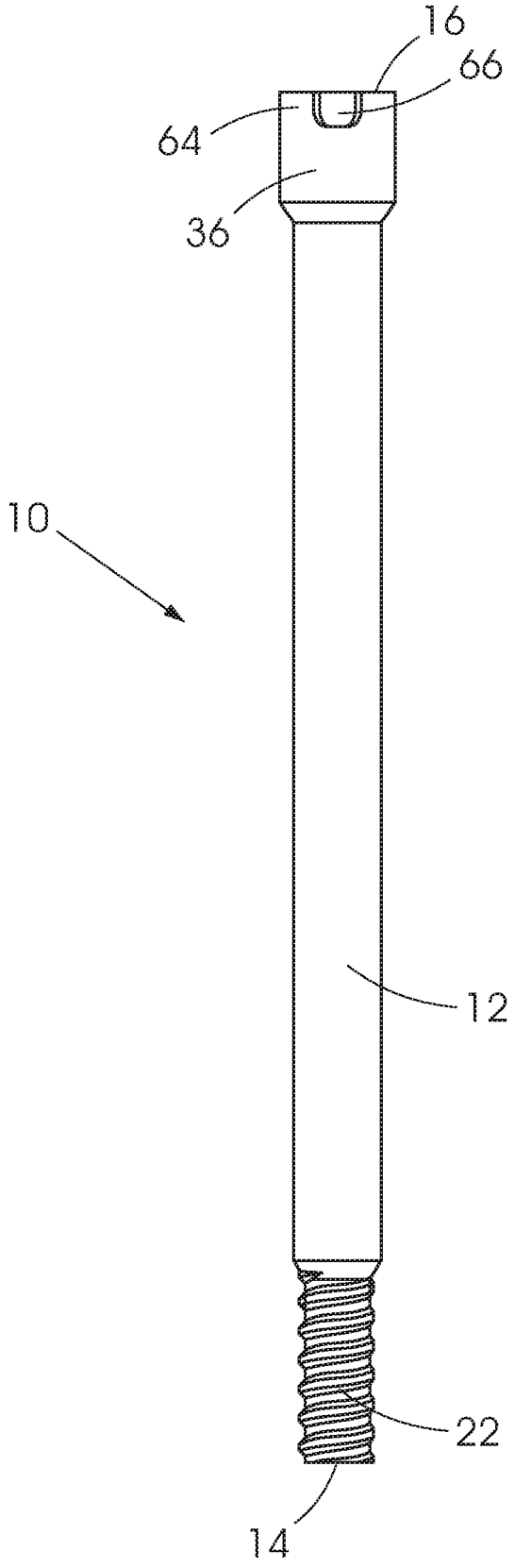
FIG. 2 is a view in elevation of the rock bolt installation tool of FIG. 1.

FIG. 1 illustrates a rock bolt installation tool 10 according to the invention. The tool 10 includes a cylindrical drive shaft 12 having a proximal end 14 and a distal end 16.

Figure 4:
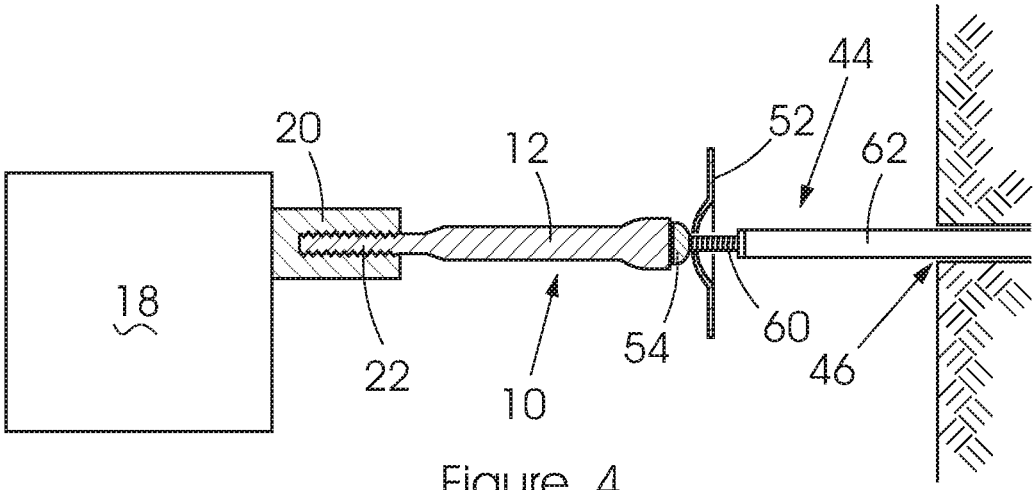
FIG. 4 schematically illustrates an installation system for a rock bolt which system includes the rock bolt installation tool.

The proximal end 14 of the shaft 12 is adapted to engage with a drill rig 18 (see FIG. 4). The proximal end can be adapted either with a male or female threaded formation that engages with a complementary formation on the drive means 20 of the drill rig. In this example, the proximal end has a male threaded formation 22.

Figure 3:
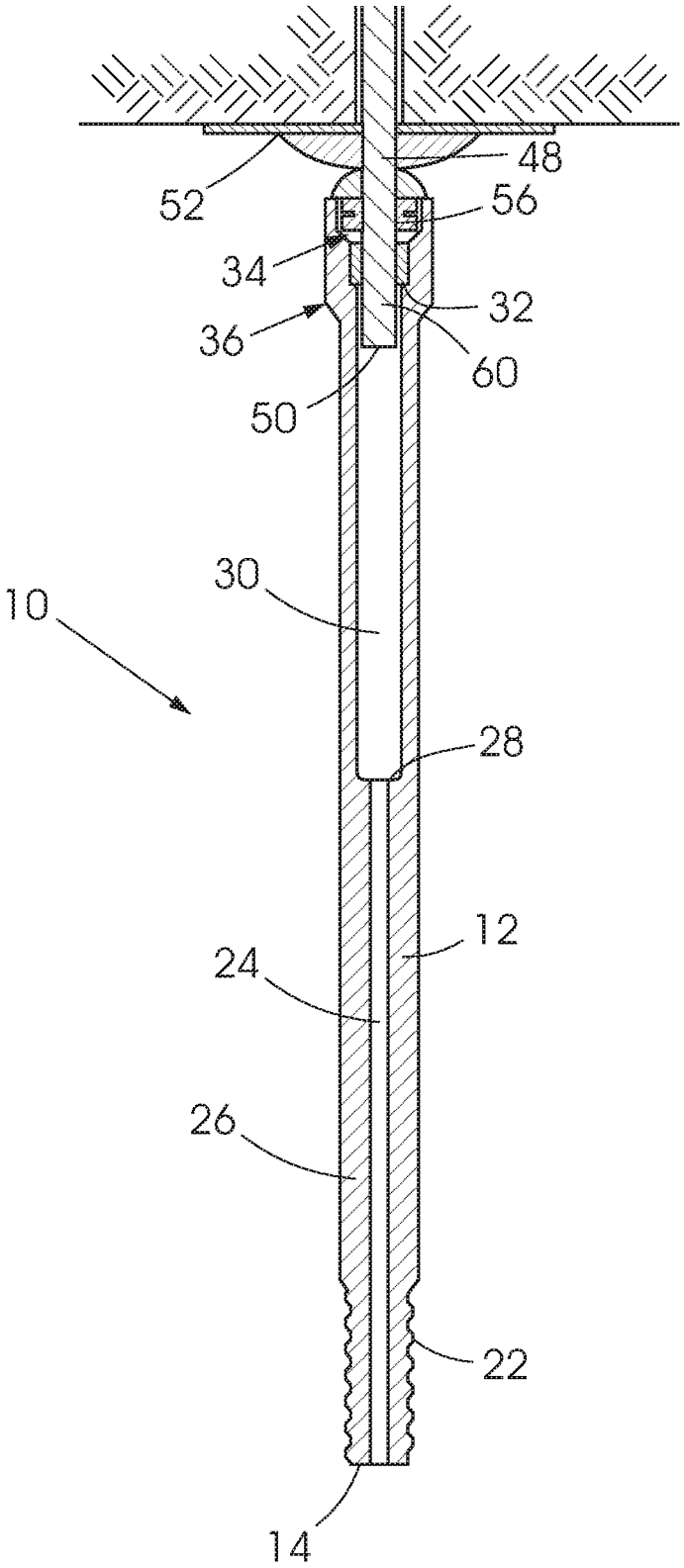
FIG. 3 is a view in longitudinal section of the tool of FIG. 1 illustrating a trailing end of a rock bolt assembly engaged with the tool.

The shaft has a conduit 24 which runs the length of the shaft (see FIG. 3), opening at each end (14, 16). The conduit is divided into three discrete sections, each adapted to provide a particular function. However, the common function is to provide a conduit for the passage of a fluid input, such as an adhesive material or a flushing medium, input from the proximal end 14.

The first section, a bore 26, extends between the proximal end 14 and an intermediate point 28. The bore is of a first diameter. The second section, a rock bolt receptacle 30, extends between the intermediate point 28 and a stepped annular first drive surface 32. The receptacle is of a second diameter, larger than the first diameter. The third section, a recess or socket 34, extends between the drive surface and the distal end 16. The recess has a variable diameter which exceeds both the first and second diameter.

Exteriorly, along a distal end portion 36 of the drive shaft 12, which ends at the distal end 16, the shaft is circumferentially enlarged to accommodate the internally larger diameter of the recess 34 contained within this portion.

The recess 34, in turn, is divided into parts: an outer load indicator receiving portion 38 (see FIG. 5) and a deeper set nut receiving portion 40 (see FIG. 6). The base of the nut receiving portion is the stepped annular drive surface 32. At an interface 42 between the nut receiving portion 40 and the load indicator receiving portion 38, the inner wall of the recess opens out to provide the load indicator receiving portion with a circumferentially larger space relatively to portion 40. This feature 42 is illustrated in FIG. 1.

The tool 10 is used to install a rock bolt assembly 44 into a pre-drilled rock hole 46. The assembly 44 typically includes a rock bolt 48 which extends between a leading end (not shown) and a trailing end 50. The rock bolt will be inserted into a pre-drilled rock hole, by the tool, leading end first. Towards the trailing end 50 the rock bolt 48 carries a domed face plate 52, a spherical seat 54 and a load indicator 56. A hexagonal nut 58, is threadedly engaged with a threaded end section 60 of the rock bolt 48, trailing the load indicator. The spherical seat is disposed between the domed faceplate and the load indicator.

In use, the rock bolt assembly 44 is engaged with the installation tool 10 by inserting the threaded end section 60 of the rock bolt 48 into the shaft 12, through the recess 34 and extending into the receptacle 30. Ingress of the rock bolt is stopped when the nut 58 contacts the annular drive surface 32 at the base of the receptacle.

The nut receiving portion 40 of the receptacle will be complementarily shaped to receive the nut in snug fit, with the recess being deep enough to contain the nut. The hex shape of this portion is partially illustrated in FIG. 1.

With the nut received in recess 34, the diametrically larger load indicator 56 is found in the adjacent load indicator receiving portion 38. This portion has enough depth so that, with the spherical seat 54 outside of the recess, abutting the distal end 16, the load indicator is spaced either from the spherical seat or the nut, the beneficial effect of which will be described below.

Figure 5:
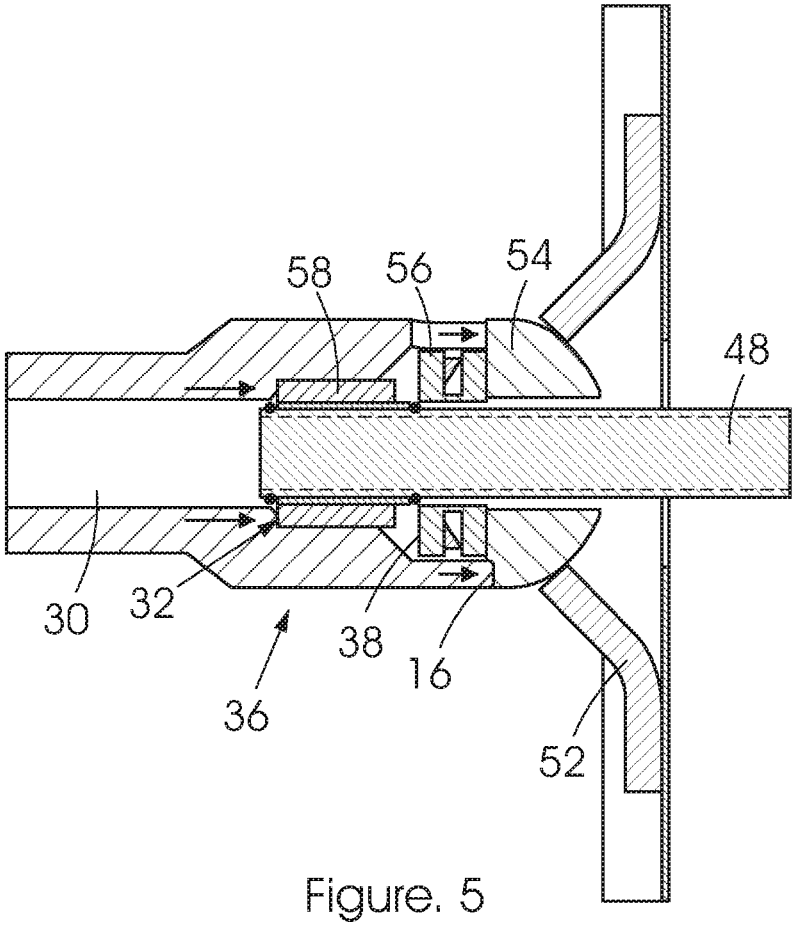
FIG. 5 illustrates a longitudinal section through an end of the rock bolt installation tool, with a trailing end of a rock bolt engaged with the tool, in a first configuration.

With the tool 10 now engaged with the drill rig 18 and with the end section 60 of the rock bolt 48, the bolt is inserted into the rock hole 46 as shown in FIG. 4, leading end first. During insertion, the nut 42 is spaced from the load indicator 56. This spacing is best illustrated in FIG. 5.

As the assembly has a friction element, being a sleeve 62, the rock bolt 48 needs to be driven into the rock hole 46 by the application of a percussive force. This force is applied by the drive means 20 of the drill rig 18 onto the installation tool. This force is transmitted to the rock bolt, via the nut, by the drive surface 32.

As the shaft of the rock bolt 46 is driven incrementally forward, into the rock hole 46, by the percussive force on the nut 58, eventually the faceplate 52 and the trailing spherical seat 54, will abut the rock wall surrounding the rock hole, pushed along by engagement of the spherical seat with the distal end 16 of the shaft 12 (hereinafter called the second drive surface).

In this position, the faceplate is forced against the rock face, prior to the rock bolt assembly being anchored in the rock hole in pre-load support of the rock face, by the force imposed on the nut and the spherical seat, by the first and the second drive seats (32, 16) respectively. This is illustrated in FIG. 5 with the forces represented directionally and locationally as arrows.

Once the bolt is fully driven into the rock hole, with the bolt having bottomed out, no longer advancing further into the hole, an operator of the drill rig operates the drive means 20 to discontinue applying an axial drive force and to now apply a rotational drive force on the nut 58. The internal hex shape of the nut receiving portion 40, now acting as a socket wrench, ensures that this driving force is efficiently applied to the nut.

As the nut 58 is rotated in this manner, the nut advances on the threads of the threaded end section 60 of the rock bolt 48, pulling away from the drive surface 32 and advancing towards the load indicator 56 until it makes contact is made with the indicator as illustrated in FIG. 6.

Further rotation and advancement of the nut 58 causes the nut to compress the load indicator between it and the spherical seat 54, until the indicator collapses as designed, to indicate that nut induced pretension of the rock bolt assembly has been achieved to a desired level. Here, the compressive force experienced by the load indicator is as a result of the nut turning on the threads of the end section 60 of the bolt in pretension of the bolt and not as a result of the percussive forces during installation.

With the clearance height of the load indicator receiving portion 38 of the recess 34 being taller than the height of the load indicator 56, the installation tool 10 can transmit this percussive force directly to the spherical seat 54 and the nut 58 without the tool being able to apply a load directly on the load indicator 56, preventing the load indicator from being prematurely squashed. In other words, the tool provides a spacing within which the load indicator is sheltered from the percussive force being applied, through the tool, to the spherical seat of the nut installation forces, ensuring that the load indicator can only collapse as a consequence of preloading the rock bolt in tension within the rock hole.

The distal end 16 of the shaft 12, preferably, is formed with turret formations 64. Between a pair of turret formations and the spherical seat 54, a space 66 is provided to allow debris, which accumulates within the tool 10 during insertion of the rock bolt assembly, to be flushed from the tool by a flushing medium channelled through the conduit.

The invention claimed is:

1. A rock bolt installation tool for use in installing a rock bolt assembly into a predrilled rock hole surrounded by a rock wall, the rock bolt assembly including a rock bolt with a threaded end section, a faceplate, a spherical seat, a load indicator, and a nut threadedly engaged with the threaded end section, the rock bolt installation tool comprising:

a drive shaft having a proximal end and a distal end, the distal end having a distalmost end surface, the proximal end being adapted to engage with a drill rig; and a socket in the distal end, the socket including a first containment portion of a first inside diameter and a second containment portion of a second inside diameter, the second containment portion being located between the first containment portion and the distalmost end surface of the distal end, the first containment portion comprising a base and a side wall, the first containment portion being adapted to receive the nut threadedly engaged with the threaded end section of the rock bolt with the nut being received within the side wall of the first containment portion and located in contact with the base, the second containment portion being adapted to receive the load indicator in a position with the load indicator initially spaced apart from either the spherical seat or the nut, wherein the base and the distalmost end surface provide a first drive surface and a second drive surface respectively which are adapted to apply, to the nut and the spherical seat respectively, an axial drive to respectively drive the rock bolt into the rock hole and the faceplate against the rock wall surrounding the rock hole, and wherein the side wall provides a rotational drive surface which is adapted to apply, to the nut, a rotational drive to cause the nut to advance along the threaded end section, away from the base, into contact with the load indicator to cause the load indicator to compress between the nut and the spherical seat.

2. The rock bolt installation tool according to claim 1 wherein the second inside diameter is larger than the first inside diameter.

3. The rock bolt assembly tool according to claim 2 wherein the proximal end of the drive shaft is adapted with a threaded male or female section.

4. The rock bolt assembly tool according to claim 3 wherein the first containment portion is adapted in a hex shape to receive a hex shaped nut.

5. The rock bolt assembly tool according to claim 4 wherein the drive shaft has a conduit which runs the length of the shaft opening at the proximal end and opening through the base, into the socket.

6. The rock bolt assembly tool according to claim 3 wherein the drive shaft has a conduit which runs the length of the shaft opening at the proximal end and opening through the base, into the socket.

7. The rock bolt assembly tool according to claim 2 wherein the first containment portion is adapted in a hex shape to receive a hex shaped nut.

8. The rock bolt assembly tool according to claim 7 wherein the drive shaft has a conduit which runs the length of the shaft opening at the proximal end and opening through the base, into the socket.

9. The rock bolt assembly tool according to claim 2 wherein the drive shaft has a conduit which runs the length of the shaft opening at the proximal end and opening through the base, into the socket.

10. The rock bolt assembly tool according to claim 1 wherein the proximal end of the drive shaft is adapted with a threaded male or female section.

11. The rock bolt assembly tool according to claim 10 wherein the first containment portion is adapted in a hex shape to receive a hex shaped nut.

12. The rock bolt assembly tool according to claim 11 wherein the drive shaft has a conduit which runs the length of the shaft opening at the proximal end and opening through the base, into the socket.

13. The rock bolt assembly tool according to claim 10 wherein the drive shaft has a conduit which runs the length of the shaft opening at the proximal end and opening through the base, into the socket.

14. The rock bolt assembly tool according to claim 1 wherein the first containment portion is adapted in a hex shape to receive a hex shaped nut.

15. The rock bolt assembly tool according to claim 14 wherein the drive shaft has a conduit which runs the length of the shaft opening at the proximal end and opening through the base, into the socket.

16. The rock bolt assembly tool according to claim 1 wherein the drive shaft has a conduit which runs the length of the shaft opening at the proximal end and opening through the base, into the socket.

17. The rock bolt installation tool according to claim 1 in combination with the rock bolt assembly comprising the rock bolt having the faceplate, the spherical seat, the load indicator and the nut threadedly engaged with the threaded end section of the bolt.

* * * * *